US010975626B2

(12) United States Patent
Fripp et al.

(10) Patent No.: US 10,975,626 B2
(45) Date of Patent: Apr. 13, 2021

(54) DEGRADABLE ABRASIVE FOR EROSIVE JET CUTTING

(71) Applicant: Halliburton Energy Services, Inc., Houston, TX (US)

(72) Inventors: Michael Linley Fripp, Carrollton, TX (US); Brady Lanclos, Houston, TX (US); Zach Walton, Carrollton, TX (US); John Charles Gano, Crossing, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 272 days.

(21) Appl. No.: 16/067,679

(22) PCT Filed: Mar. 24, 2016

(86) PCT No.: PCT/US2016/023987
§ 371 (c)(1),
(2) Date: Jul. 2, 2018

(87) PCT Pub. No.: WO2017/164878
PCT Pub. Date: Sep. 28, 2017

(65) Prior Publication Data

US 2019/0017329 A1 Jan. 17, 2019

(51) Int. Cl.
*E21B 43/114* (2006.01)
*E21B 7/18* (2006.01)
(Continued)

(52) U.S. Cl.
CPC ..... *E21B 7/18* (2013.01); *B24C 1/003* (2013.01); *B24C 1/045* (2013.01); *B24C 11/00* (2013.01); *B24C 11/005* (2013.01); *E21B 43/114* (2013.01)

(58) Field of Classification Search
None
See application file for complete search history.

(56) References Cited

U.S. PATENT DOCUMENTS 4,920,704 A 5/1990 Caserta et al.
5,291,956 A * 3/1994 Mueller ..... E21B 7/18 175/424

(Continued)

FOREIGN PATENT DOCUMENTS

| | | |
|---|---|---|
| EP | 878236 | 11/1998 |
| GB | 1538433 | 1/1979 |
| WO | 2014120461 | 8/2014 |

OTHER PUBLICATIONS

Halliburton Energy Services Inc. "Hydra-Jet Pro Service", available online at http://www.halliburton.com/public/bc/contents/Data_Sheets/H03491.pdf, as early as Jan. 2015, 2 pages.

(Continued)

*Primary Examiner* — Andrew Sue-Ako
(74) *Attorney, Agent, or Firm* — Kilpatrick Townsend & Stockton LLP

(57) ABSTRACT

An erosive jet can propel degradable, abrasive grit conveyed in a carrier fluid to erode a downhole structure, such as a tubular (e.g., cutting through a tubular) or formation (e.g., perforation actions). The abrasive grit can be selected to degrade or dissolve in the wellbore fluid (e.g., in carrier fluid pumped into the wellbore or in fluid originating from the wellbore). The abrasive grit can provide increased cutting or erosion efficiency in the erosive jet during the cutting operation, then may degrade (e.g., dissolve) in the wellbore fluid to avoid certain complications, such as clogging or residue build-up in the wellbore formation or on downhole equipment. A degradation accelerator can be introduced (e.g., in carrier fluid) to accelerate degradation of the abrasive grit in the wellbore fluid. Degradation accelerators can (Continued)

be temperature-activated, pH-activated, or otherwise time-delayed so the abrasive grit remains sufficiently intact to perform the desired erosion operation.

20 Claims, 7 Drawing Sheets

(51) Int. Cl.

| | |
|---|---|
| ***B24C 1/00*** | (2006.01) |
| ***B24C 1/04*** | (2006.01) |
| ***B24C 11/00*** | (2006.01) |

(56) References Cited

U.S. PATENT DOCUMENTS

| | | | |
|---|---|---|---|
| 5,366,015 | A | 11/1994 | Surjaatmadja et al. |
| 5,527,204 | A | 6/1996 | Rhoades |
| 7,506,689 | B2 | 3/2009 | Surjaatmadja et al. |
| 7,625,846 | B2 | 12/2009 | Cooke, Jr. |
| 2002/0092650 | A1 | 7/2002 | Tolman et al. |
| 2005/0183741 | A1 | 8/2005 | Surjaatmadja et al. |
| 2007/0284106 | A1 | 12/2007 | Kalman et al. |
| 2011/0136707 | A1* | 6/2011 | Xu ..... C22C 1/0408 507/270 |
| 2015/0144343 | A1* | 5/2015 | Mazyar ..... E21B 43/16 166/300 |

OTHER PUBLICATIONS

Kulekci , "Processes and apparatus developments in industrial waterjet applications", International Journal of Machine Tools and Manufacture, vol. 42, No. 12, Sep. 2002, pp. 1297-1306.

International Patent Application No. PCT/US2016/023987 , "International Search Report and Written Opinion", dated Dec. 19, 2016, 15 pages.

* cited by examiner

DEGRADABLE ABRASIVE FOR EROSIVE JET CUTTING

TECHNICAL FIELD

The present disclosure relates to oilfield operations generally and more specifically to downhole waterjet cutting and abrasives used therewith.

BACKGROUND

In oilfield operations, erosive jet cutting (e.g., waterjet cutting) apparatuses can be used to cut through materials, such as tubular walls (e.g., downhole tools, casing string, or other tubulars), penetrate formations (e.g., rock and materials surrounding a wellbore), or even remove materials or buildup on equipment (e.g., scaling that builds up on a tubular wall). Erosive jet cutting can employ a fluid (e.g., water) that is pumped through a nozzle at a pressure high enough to erode a targeted material (e.g., tubular wall). In some cases, abrasive grit can be added to the fluid being used in an erosive jet cutting operation.

Abrasive grits can increase the erosive properties of the erosive jet cutting operation. In surface operations, the abrasive grit can be captured and reused or disposed of; however, in downhole operations, abrasive grit can settle into the wellbore, plug screens, interfere with sliding tools, or cause other problems. These difficulties tied to the use of abrasive grit can result in damage to equipment or wellbore, loss of time and loss of equipment, and increased dangers in and around the wellbore (e.g., due to unexpected pressure increases when damaged equipment does not operate as planned).

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
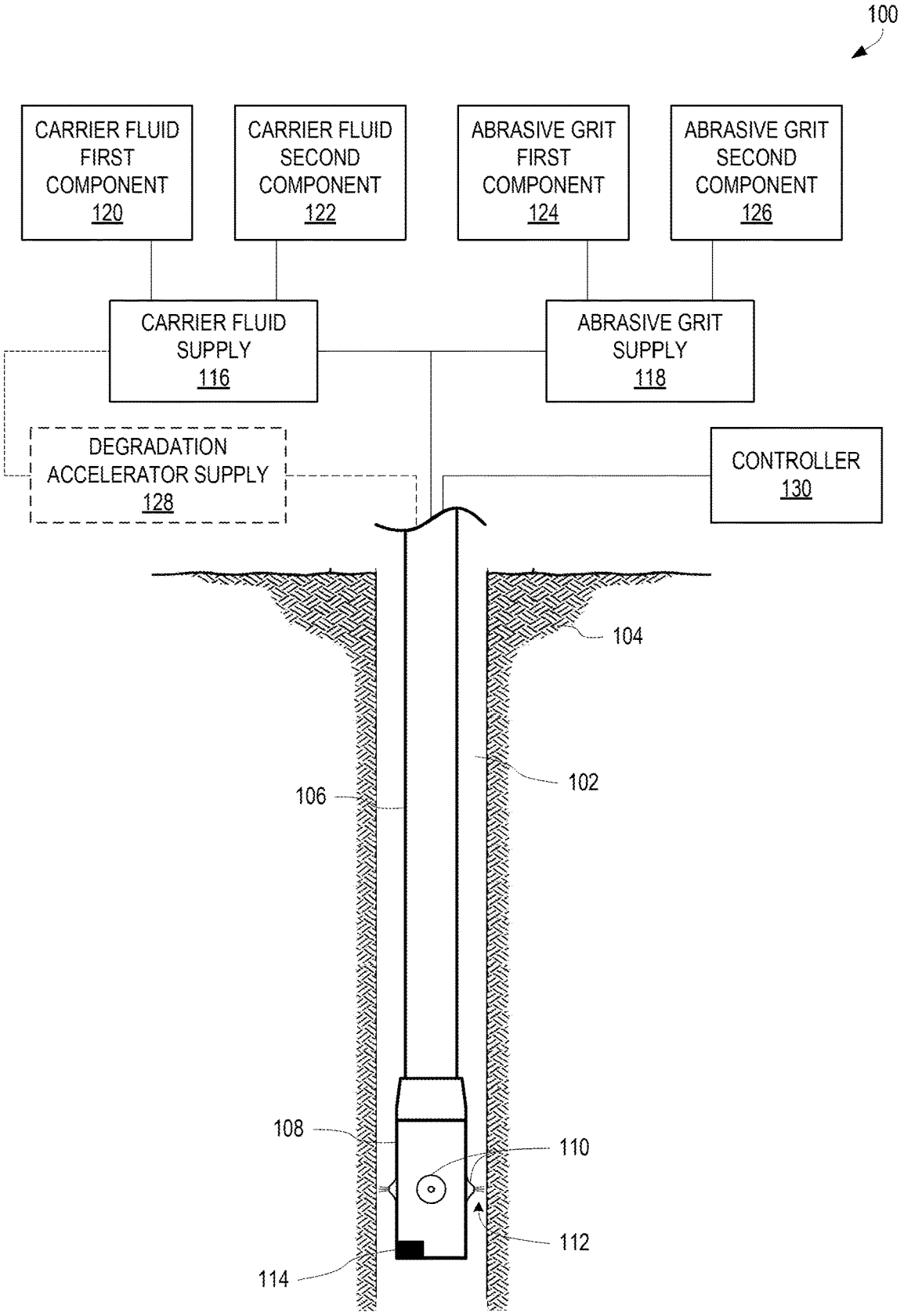
FIG. 1 is a combination schematic and block diagram of a wellbore servicing system that includes a erosive jetting device according to certain aspects of the present disclosure

Certain aspects and features of the present disclosure relate to an erosive jet having degradable, abrasive grit conveyed in a carrier fluid. The erosive jet can be a waterjet (e.g., using water as a carrier fluid) or can use another carrier fluid. The erosive jet can be used to erode a downhole structure, such as a tubular (e.g., cutting through a tubular) or formation (e.g., perforation actions). The abrasive grit can degrade or dissolve in the wellbore fluid (e.g., in carrier fluid pumped into the wellbore or in fluid originating from the wellbore). The abrasive grit can provide increased cutting or erosion efficiency in the erosive jet during the cutting operation, then may degrade (e.g., dissolve) to avoid certain complications, such as clogging or residue build-up in the wellbore formation or on downhole equipment. In some cases, a degradation accelerator can be pumped into the wellbore, such as with the carrier fluid, to increase the speed of degradation of the abrasive grit. The degradation accelerator can be temperature-activated, pH-activated, or otherwise time-delayed so the abrasive grit remains sufficiently intact to perform the desired cutting or erosion operation before degrading in the wellbore fluid.

Abrasive grit can degrade through corrosion, galvanic corrosion, dissolution, or other mechanisms. Abrasive grit can include one or more components (e.g., different materials combined together). The components of abrasive grit can be selected to impart desired properties on the abrasive grit. Components of the abrasive grit can be selected to increase specific gravity of the abrasive grit, to increase the erosive coefficient of the abrasive grit (e.g., having a higher hardness value than the object desired to be eroded away), or for other properties. For example, components can be selected to be higher on the galvanic series than other materials to increase the rate of degradation of the abrasive grit. In some aspects, abrasive grit can be composed of gallium and an aluminum alloy. The aluminum alloy can provide erosive qualities (e.g., a high hardness) and the gallium can aid in degradation of the aluminum alloy in water. Components of abrasive grit can include dissolvable metals, such as magnesium, zinc, or alloys thereof. In some cases, at least one component of the abrasive grit is a metal. The use of a metal as a component of abrasive grit can impart desirable properties on the abrasive grit, such as high strength, high density, a high degree of control of degradation speed, and ability to be stored for long periods of time (e.g., in specific storage fluids, such as oil). The use of a metal component in the abrasive grit, such as opposed to non-metal components like certain plastic or glass components, can provide a higher density, which can allow for desired erosion to occur at lower jetting pressures and at distances further away from the target material. In some cases, instead of or in addition to a metal component, the abrasive grit can include a plastic component or a glass component (e.g., borax glass). The plastic component or glass component can be dissolvable or degradable. Examples of suitable dissolvable or degradable plastics can include polylactide acid (PLA), poly glycolic acid (PGA), polyvinyl alcohol (PVA), cellulose, urethane, esters, thiol, and other hydrolytically degradable polymers. Hydrolytically degradable polymers can include polymers that have functional groups that are susceptible to hydrolysis and include esters, orthoesters, anhydrides, carbonates, amides, urethanes, ureas, and the like.

Components of abrasive grit can be combined together in any suitable way. Examples of ways to combine abrasive grit can include: through mechanical mixture (e.g., mixture of solid particles), solid solution (e.g., a continuous phase of intergranular or intragranular inclusion, such as mixed together in a molten state), encapsulation (e.g., a first component surrounding a second component), or sintering or forging (e.g., joining granules together, such as without without completely melting),. Other techniques for combining components of abrasive grit together can be used.

The speed and degree of degradation of the abrasive grit can be controlled, before, during, or after an erosive jetting operation, by adjusting properties of the carrier fluid or the wellbore fluid. For example, during initial stages of a cutting operation, the carrier fluid can be composed of mostly water (e.g., a neutral pH), but during the final stages of a cutting operation, the carrier fluid can include a degradation accelerator that has a lower pH (e.g., hydrofluoric acid), which can accelerate the degradation of the abrasive grit, such as through galvanic corrosion. In another example, a degradation accelerator can be introduced to the wellbore fluid after a cutting operation, through the same or a separate conveyance as the supply line for the erosion fluid. In yet another example, the carrier fluid can include a temperature-activated, pH-activated, or other activatable component selected to activate in the downhole environment (e.g., due to the heat, pressure, hydration, temperature, pH, or other factors of the downhole environment). Upon activation, the activatable component can accelerate the degradation of the abrasive grit, thus keeping the abrasive grit intact during the cutting process and only accelerating degradation once the abrasive grit and the carrier fluid reaches the downhole environment (e.g., approximately after the abrasive grit has impinged the target).

Sensory equipment can measure downhole properties (e.g., temperature, pH, pressures, visual inspection, weight, or other parameters) to determine the status of the erosive jet operation. Measurements can be made of the downhole environment, the wellbore, fluid in the wellbore, and tubulars in the wellbore. Measurements can be made from within the wellbore or from the surface (e.g., weight on bit). The makeup of the abrasive grit and carrier fluid, as well as the addition of any degredation accelerators, can be controlled by a controller coupled to the sensory equipment. The controller can automatically adjust the components of the abrasive grit and carrier fluid, as well as the addition of degredation accelerators, based on the downhole properties. For example, during a cutting operation, when a detected weight or pressure indicates a tubular has been fully cut through or is almost fully cut through, the controller can adjust the makeup of the abrasive grit to increase the degradability of the abrasive grit and can adjust the makeup of the carrier fluid to introduce additional degradation accelerators. The degradation rate of the abrasive grit in the downhole environment can increase in response to a detected event (e.g., cutting of the tubular).

In some cases, abrasive grit can be pre-applied to a grinding surface (e.g., grinding wheel) rather than conveyed in a carrier fluid. A working fluid similar to a carrier fluid can pass over the grinding surface during a grinding operation. The working fluid can be controlled to adjust the degradation of the abrasive grit on the grinding surface. In some cases, the grinding surface can include multiple layers. Deeper layers can be presented only when its surrounding layer has degraded away, through normal erosion, through contact with wellbore fluid, or through the use of degradation accelerators.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a combination schematic and block diagram of a wellbore servicing system 100 that includes an erosive jetting device 108 according to certain aspects of the present disclosure. The erosive jetting device 108 can include one or more nozzles 110 for outputting a jet 112 of erosion fluid. The nozzles 110 can be made from a ceramic (e.g., tungsten carbide or silicon carbide), a metal (e.g., steel), or any other suitable material. The terms erosion, erosive, and the like can refer to processes of removing, breaking, cutting, destroying, perforating, disintegrating, abrading, wearing, grinding down, or otherwise impacting a material. The term "erosive jetting device" can be inclusive of devices for brushing off scale, rust, coatings, paraffin or other build-ups from a tubing (e.g., from the inner diameter of a tubing), devices for cutting tubing, devices for perforating casing, devices for perforating formations, and the like. An erosion fluid can refer to the combination of abrasive grits conveyed in a carrier fluid. An example of an erosive jetting device is a waterjet device. An example of erosion fluid is waterjet fluid (e.g., abrasive grit entrained in water).

The wellbore servicing system 100 also includes a wellbore 102 penetrating a subterranean formation 104 for recovering hydrocarbons, storing hydrocarbons, disposing of carbon dioxide, or the like. The wellbore 102 can be drilled into the subterranean formation 104 using any suitable drilling technique. While shown as extending vertically from the surface in FIG. 1, in other examples the wellbore 102 can be deviated, horizontal, or curved over at least some portions of the wellbore 102. The wellbore 102 can be cased, open hole, contain tubing, and can include a hole in the ground having a variety of shapes or geometries.

A service rig (not shown), such as a drilling rig, a completion rig, a workover rig, other mast structure, or combination thereof, can support the erosive jetting device 108 in the wellbore 102, but in other examples a different structure can support the erosive jetting device 108. The erosive jetting device 108 can be further supported by a conveyance 106, which can be a wireline, slickline, cable, tubular (e.g. drill string, casing string, completion string, coiled tubing or the like), or other structure suitable for supporting the erosive jetting device 108. In some aspects, a service rig can include a derrick (not shown) with a rig floor through which the conveyance 106 extends downward from the service rig into the wellbore 102. In an offshore situation, the service rig can be supported by risers or piers extending downwards to a seabed in some implementations. Alternatively, the service rig can be supported by columns sitting on hulls or pontoons (or both) that are ballasted below the water surface, which may be referred to as a semi-submersible platform or rig. In an off-shore location, tubing may extend from the service rig to exclude sea water and contain drilling fluid returns. Other mechanical mechanisms that are not shown may control the run-in and withdrawal of the conveyance 106 in the wellbore 102. Examples of these other mechanical mechanisms include a draw works coupled to a hoisting apparatus, a slickline unit or a wireline unit including a winching apparatus, another servicing vehicle, or other such mechanisms. The erosive jetting device 108 can be incorporated in another, existing downhole tool.

Erosion fluid can be supplied to the erosive jetting device 108 through the conveyance 106, although a secondary conveyance can be used in other examples. Erosion fluid can include carrier fluid from a carrier fluid supply 116, abrasive grit from an abrasive grit supply 118, and, optionally, degradation accelerator from a degradation accelerator supply 128. The carrier fluid supply 116, shown in block diagram, can include any suitable device for conveying, storing, or mixing fluids, which may include a tank, vessel, container, pump, agitator, mixer, or other components. The abrasive grit supply 118, shown in block diagram, can include any suitable devices for conveying, storing, or mixing solids, which may include a tank, vessel, container, pump, agitator, mixer, or other components. The carrier fluid first component 120 and carrier fluid second component 122, as well as the abrasive grit first component 124 and abrasive grit second component 126, all shown in block diagram, can be any suitable devices for conveying or storing fluids or solids, respectively, which may include tanks, vessels, containers, pumps, or other components. The degredation accelerator supply 128, shown in block diagram, can be any suitable device for conveying, storing, or mixing fluids or solids, which may include a tank, vessel, container, pump, agitator, mixer, or other components. In some cases, the degradation accelerator supply 128 can be a separate input to the erosion fluid, an input to the carrier fluid supply 116, or an input to the abrasive grit supply 118. In some cases, the degradation accelerator supply 128 can supply the degradation accelerator to the downhole environment separate of the erosion fluid, such as through a separate conveyance or through the same conveyance, but when erosion fluid is not being conveyed.

A carrier fluid can include a combination of one or more components. In some cases, the carrier fluid supply 116 can operate to mix a carrier fluid first component 120 and a carrier fluid second component 122, or any number of components. Mixing of carrier fluid can occur on demand based on manual or automatic controls, such as from controller 130. As described above, in some cases, the carrier fluid supply 116 can mix carrier fluid using the degradation accelerator form the degradation accelerator supply 128. In some cases, one of the carrier fluid components is a degradation accelerator. Examples of suitable carrier fluid components include liquids such as water, oils, brine, completions fluids, mud, drilling fluids, or other liquids. Examples of suitable carrier fluid components can also include gases such as carbon dioxide, methane, nitrogen, and air. Examples of suitable carrier fluid components can include combinations of liquids or gases including emulsions, gels, and foams.

Abrasive grit can include a combination of one or more components. In some cases, the abrasive grit supply 118 can operate to mix an abrasive grit first component 124 and an abrasive grit second component 126, or any number of components. Mixing of abrasive grit can occur on demand based on manual or automatic controls, such as from controller 130. Controller 130, shown in block diagram, can be any devices suitable for providing automatic or automated control as described herein. Controller 130 can be electrical (e.g., analog or digital controller for controlling electrical actuators), hydraulic or pneumatic (e.g., fluid feedback loop for controlling hydraulic or pneumatic actuators), mechanical (e.g., mechanical feedback loop for controlling mechanical actuators), or otherwise operated. Examples of suitable controllers include processors (e.g., microprocessors), computers, analog controllers, programmable logic controllers, and other suitable devices.

In some cases, a sensor 114 can measure downhole parameters, such as parameters of the wellbore 102, the formation 104, or any equipment in the wellbore (e.g., conveyance 106 or erosive jetting device 108). The sensor 114 can be positioned in the wellbore 102 or elsewhere, such as at the surface or incorporated in service rig equipment. The sensor 114 can record temperatures, pH levels, pressures, weights, or other parameters. In some cases, sensor 114 can be a camera that provides a visual inspection of a downhole parameter (e.g., whether or not a perforation through casing has occurred or whether or not a tubular has been fully cut). Sensor 114 can be operatively coupled to controller 130 to provide sensor data. In an example, sensor 114 can include a fiber optic cable. In some cases, a downhole parameter can be calculated or estimated based on measurements taken from outside of the wellbore.

The controller 130 can use the sensor data to determine what adjustments may be necessary or desirable for the erosion operation. The controller 130 can be coupled to one or more of the degradation accelerator supply 128, the carrier fluid supply 116, or the abrasive grit supply 118. In some cases, the controller 130 can be coupled to other equipment, such as pumps, switches, valves, and the like. Based on the sensor data, the controller 130 can make adjustments to the erosion fluid being pumped through the erosive jetting device 108, such as by adjusting the makeup of the carrier fluid, the makeup of the abrasive grit, or the supply of degradation accelerator. For example, if the controller 130 determines that an operation is complete or nearing end of completion (e.g., through analysis of video data or other measured data), the controller 130 can automatically increase the supply of degradation accelerator from the degradation accelerator supply 128 (e.g., through the carrier fluid) to induce degradation of the abrasive grit (e.g., increase the susceptibility of the abrasive grit to degrade) in the wellbore 102.

In some cases, erosion fluid can be prepared offsite or in advance of an erosion jet operation. In such cases, on-demand adjusting of the carrier fluid and abrasive grit may not occur. But, on-demand addition of degradation accelerator may still be possible. For example, erosion fluid and degradation accelerator may be supplied in separate storage tanks. Erosion fluid can be used first to perform the erosion operation. Near, during, or after completion of the erosion operation, degradation accelerator can be supplied to induce degradation of the abrasive grit.

In some cases, abrasive grit can be located on a grinding tool (e.g., a grinding disk or roll). Instead of using a jet of erosion fluid to erode a material, the grinding tool can be drawn across the material (e.g., by rotating the grinding disk) to erode the material. In such cases, fluid similar to carrier fluid can be used to lubricate the grinding tool. Degradation accelerator can be introduced to induce degradation of the abrasive grit (e.g., abrasive grit on the grinding tool or abrasive grit in wellbore fluid). As described above with reference to the carrier fluid and degradation accelerator, the makeup of the carrier fluid and the presence of degradation accelerator can be controlled on-demand, such as through manual or automatic control.

In some cases, a grinding tool can include multiple layers, as described herein. Degradation accelerator can be used to remove outer layers, thus exposing deeper layers. Sequential layers can provide different properties, such as different abrasive grit having different hardness values and different degradation rates.

Figure 2:
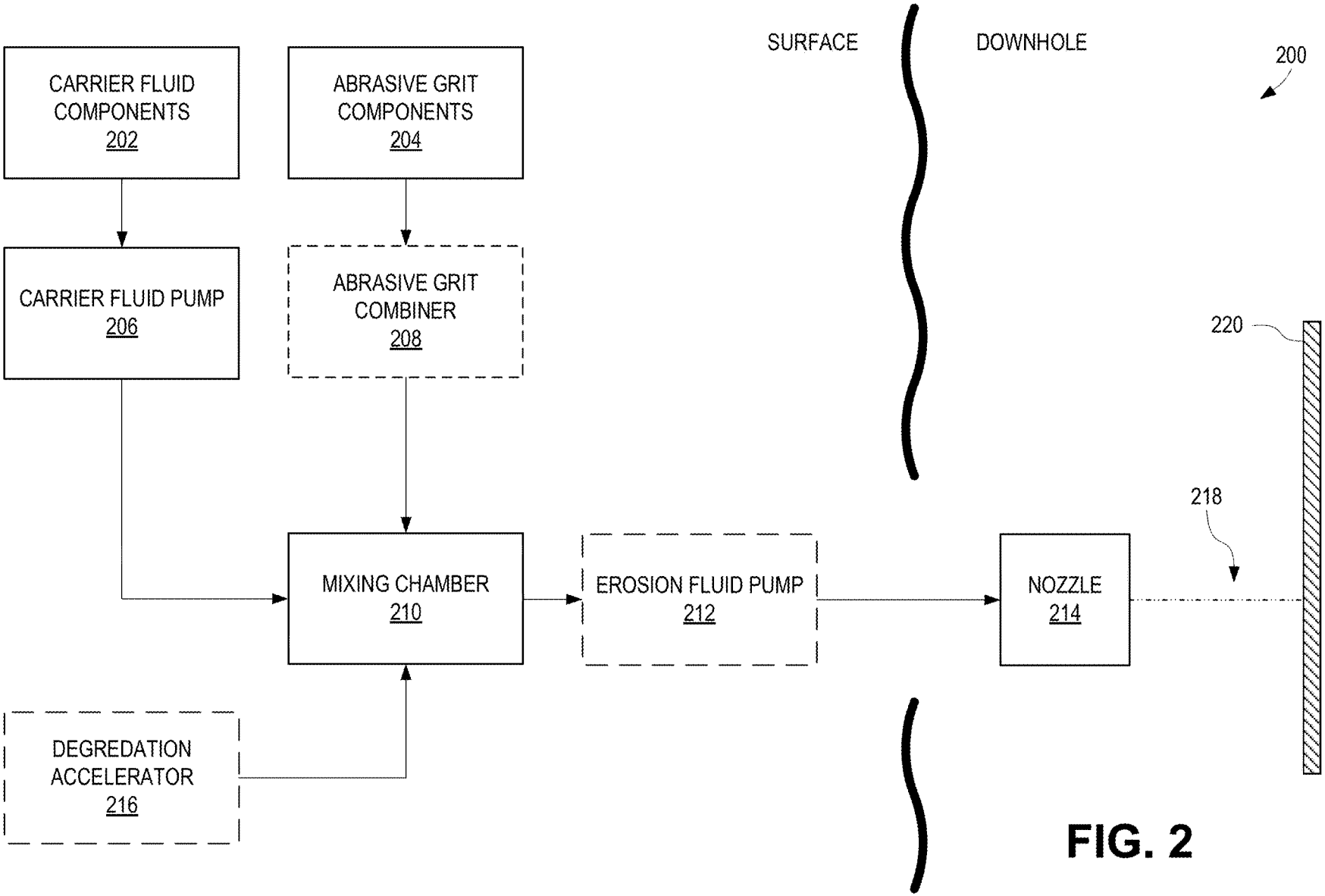
FIG. 2 is a combination schematic and block diagram depicting a erosion jet system equipped for on-demand erosion fluid mixing according to certain aspects of the present disclosure.

FIG. 2 is a combination schematic and block diagram depicting a erosion jet system 200 equipped for on-demand erosion fluid mixing according to certain aspects of the present disclosure. FIG. 2 is shown as a block diagram except for jet 218 and target material 220, which are shown as schematic diagrams. A carrier fluid pump 206 can pressurize carrier fluid components 202 into a mixing chamber 210. The carrier fluid components 202 can be mixed with abrasive grit components 204 in the mixing chamber 210, resulting in an erosion fluid. The erosion fluid can include carrier fluid and entrained abrasive grit. In some cases, abrasive grit is pulled into the mixing chamber 210 through a venture effect, although other types of mixing chambers 210 can be used.

The erosion fluid can be conveyed to nozzle 214. The pressurized erosion fluid received by the nozzle 214 can be focused into a jet 218 of erosion fluid that impinges a target material 220 (e.g., a tubular). In some cases, an optional erosion fluid pump 212 can be used to further pressurize the erosion fluid before the erosion fluid is received by the nozzle 214.

In some cases, abrasive grit components 204 can be combined by an abrasive grit combiner 208 into an abrasive grit before entering the mixing chamber 210. The abrasive grit combiner 208 can combine, or mix, one or more abrasive grit components 204 together. The abrasive grit components 204 can include at least a metal component. The metal component can be a metal that is degradable in a downhole environment, such as when contacted with wellbore fluid or degradation accelerator in the downhole environment. Examples of suitable metal components include a magnesium-based alloy, an aluminum-based alloy, a zinc-based alloy, an iron-based alloy, or a tin-based alloy. Other metal components can be used. In some cases, instead of or in addition to a metal component, the abrasive grit components 204 can include a plastic component or a glass component (e.g., borax glass). The plastic component or glass component can be dissolvable or degradable.

In some cases, the abrasive grit can include additional abrasive grit components 204 selected to increase the rate of degradation of the abrasive grit, to increase the specific gravity of the abrasive grit or the resultant erosion fluid, or otherwise affect the abrasive grit or resultant erosion fluid. Examples of additional abrasive grit components 204 that increase the rate of degradation include iron, tungsten, carbon, nickel, copper, silver, titanium, indium, and gallium, although other materials may be used. Examples of additional abrasive grit components 204 that increase specific gravity include iron, tungsten, nickel, tantalum, hafnium, lead, silver, copper, zinc, or yttrium, although other materials may be used. Examples of additional abrasive grit components 204 that increase erosive coefficient of the abrasive grit include ceramics, sand, diamond, carbide coatings, and nitride coatings, although other materials may be used.

In some cases, additional abrasive grit components 204 can be used. Examples of such additional abrasive grit components 204 include salt, borax, carbonate, and dissolvable plastics, although other materials may be used.

Abrasive grit components 204 can be fabricated through any suitable process, including crushing (e.g., in a hammer mill), micro-gravity casting (e.g., in a drop tower), casting, centrifugal casting, or other processes. The approximate diameter of the metal component of the abrasive grit components 204 can be greater than 0.5 microns, greater than 1 micron, smaller than 20 mm, smaller than 10 mm, or anywhere between approximately 1 micron and 10 mm in diameter. Some suitable sizes for metal component can be approximately 0.063 mm to approximately 0.13 mm, approximately 0.13 mm to approximately 0.25 mm, approximately 0.25 mm to approximately 0.5 mm, approximately 0.5 mm to approximately 1 mm, or approximately 1 mm to approximately 2.0 mm in diameter. Additional abrasive grit components 204 can have sizes in any of the ranges given above with regard to the metal component, or can have other sizes.

The makeup of the abrasive grit (e.g., the combination of the abrasive grit components 204) can be selected to have desirable properties, such as a desirable erosion coefficient (e.g., a desirable hardness), a desirable specific gravity, or a desirable degradation rate (e.g., a low degradation rate in a carrier fluid but a high degradation rate in wellbore fluid). For example, the abrasive grit can include sufficient metal components and additional abrasive grit components 204 to achieve a hardness high enough to erode the target material 220. In some cases, the makeup of the abrasive grit can be adjusted on-demand (e.g., manually or automatically) to erode different materials. For example, during an erosive jetting operation, the abrasive grit may initially include components giving it a high erosion coefficient to cut through a steel tubular. After cutting of the tubular is detected, the system 200 can automatically adjust the makeup of the abrasive grit to include components giving it a lower erosion coefficient to remove scale from the casing of the wellbore without perforating the wellbore casing. In some cases, a hard abrasive grit may be used to cut through the wellbore casing and a softer abrasive grit may be used to cut through the cement and into the formation.

When degrading, the abrasive grit can completely dissolve (e.g., in the wellbore fluid), can break apart into smaller particles and lose its mechanical strength, can become chemically altered to lose its mechanical strength, or can otherwise be affected to reduce the ability of the abrasive grit to cause complications associated with clogs, blockages, or buildups of abrasive grit.

Carrier fluid components 202 can include water or other fluids. In some cases, multiple carrier fluid components 202 can be used. The mixture of carrier fluid components 202 can be controlled through various pumps and valves. In some cases, a degradation accelerator can be a carrier fluid component. In other cases, a degradation accelerator 216 can be separately introduced into the mixing chamber 210, such as through a degradation accelerator pump.

A degradation accelerator can be any material (e.g., fluid) that alters the susceptibility of the abrasive grit (e.g., at least the metal component of the abrasive grit) to degrade in the downhole environment. The degradation accelerator can induce degradation of the abrasive grit on its own, or in conjunction with the downhole environment. For example, the degradation accelerator can increase the ability for the abrasive grit to dissolve in wellbore fluid. Examples of suitable degradation accelerator can include acids (e.g., hydrofluoric acid, acetic acid, citric acid, paracetic acid, and hydrochloric acid), oxidizers (e.g. potassium perchlorate and sodium perchlorate, et cetera), brines (e.g. sodium chloride brine, and potassium chloride brine) or other materials for inducing degradation of the metal component of the abrasive grit.

In some cases, the degradation accelerator can be activatable in the presence of certain conditions or other materials that occur in a downhole environment. An activatable degradation accelerator, when not activated, may not induce or otherwise increase degradation of the abrasive grit, but when activated, can induce or increase degradation of the abrasive grit. In some cases, an activatable degradation accelerator can more strongly induce degradation (e.g., faster degradation) of the abrasive grit when activated than when not activated. An activatable degradation accelerator can be temperature-activated, pH-activated, activated when in contact with particular materials (e.g., wellbore fluid), or otherwise. An example of an activatable degradation accelerator can include an anhydrous acid that can lower pH and induce degradation of the abrasive grit when subjected to high enough temperatures (e.g., temperatures above surface temperatures but below temperatures of a downhole environment). In some cases, the degradation accelerator can include encapsulated powered acids or encapsulated powered oxidizers. Such powdered degradation accelerators may be mixable with the abrasive grit and may be activatable when mixed with water. For example, an anhydrous acid mixed with abrasive grit may be inactive while dry and may become hydrated when mixed with water and may acidize the carrier fluid. In some cases, an encapsulated powder may be subjected to a material or process to remove the encapsulation for activation.

Figure 3:
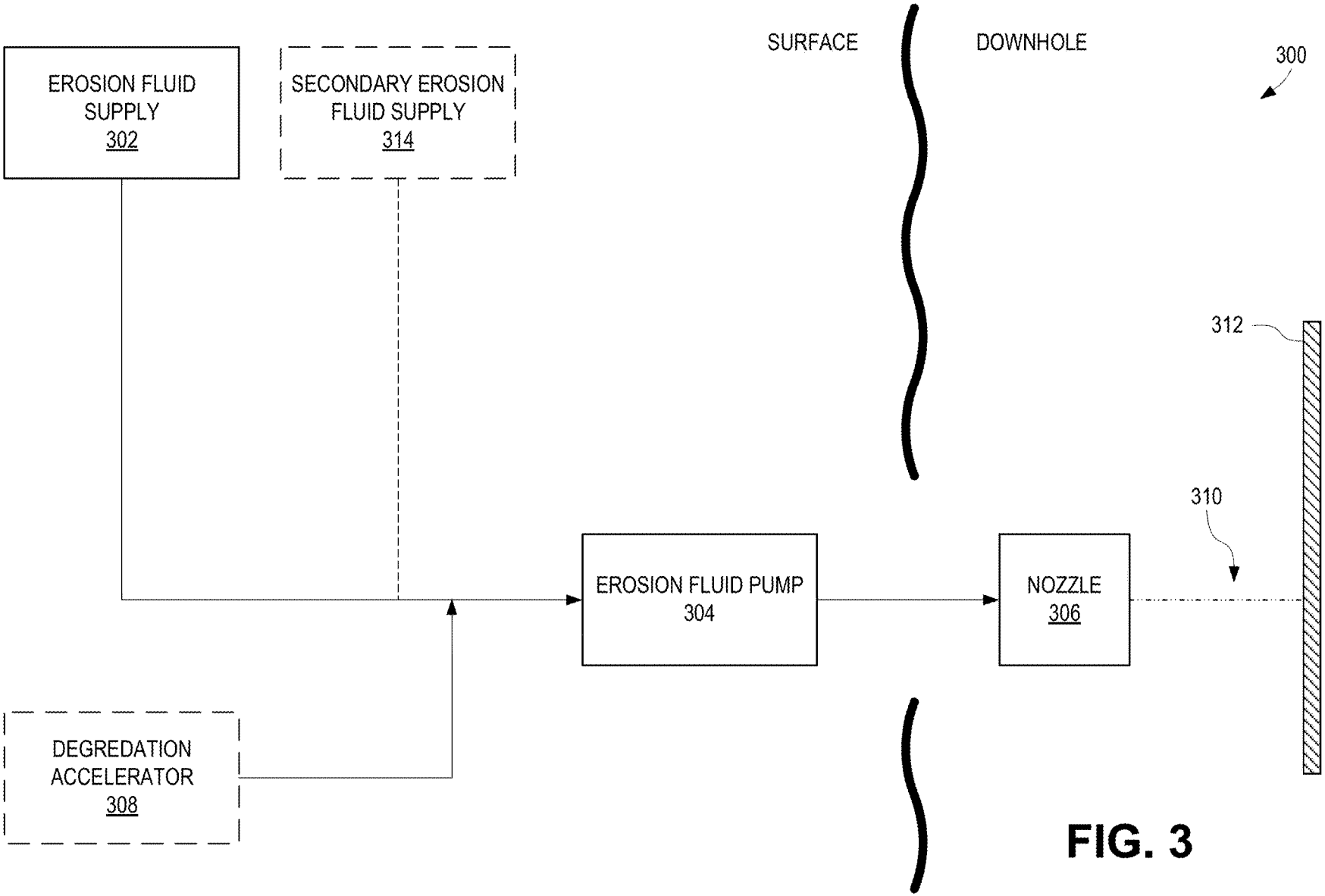
FIG. 3 is a combination schematic and block diagram depicting a erosion jet system using pre-mixed erosion fluid according to certain aspects of the present disclosure.

FIG. 3 is a combination schematic and block diagram depicting an erosion jet system 300 using pre-mixed erosion fluid according to certain aspects of the present disclosure. FIG. 3 is shown as a block diagram except for jet 310 and target material 312, which are shown as schematic diagrams. The erosion jet system 300 includes a nozzle 306, similar to nozzle 214 of FIG. 2, through which a jet 310 of erosion fluid exits, impinging a target material 312. The nozzle 306 receives pressurized erosion fluid from an erosion fluid pump 304. The erosion fluid pump is fed from an erosion fluid supply 302. The erosion fluid supply 302 includes erosion fluid containing abrasive grit carried by or entrained in a carrier fluid. The abrasive grit and carrier fluid can be the same as described herein, such as described with reference to FIG. 2.

In some cases, a degradation accelerator 308 can be added to the pre-mixed erosion fluid and pumped through nozzle 306, such as through the manual or automatic control of valves or pumps coupled to a supply of the degradation accelerator 308.

In some cases, a secondary erosion fluid supply 314 can be additionally used. The secondary erosion fluid supply 314 can contain a different mixture of abrasive grit and carrier fluid than the erosion fluid supply 302. In some cases, the secondary erosion fluid supply 314 can include a degradation accelerator. The system 300 may include automatic or manually controlled valves, pumps, or other equipment for drawing erosion fluid from only the erosion fluid supply 302, only the secondary erosion fluid supply 314, or a combination of the two. In some cases, additional erosion fluid supplies can be used (e.g., more than two). In some cases, automatic controls can be based on time or a sensed downhole parameter (e.g., as sensed by sensor 114 of FIG. 1). For example, the system 300 can switch from the erosion fluid supply 302 to the secondary erosion fluid supply 314 upon detection of a downhole event, such as upon detecting that a perforation of a tubular has been successful. The switch to the secondary erosion fluid supply 314 can provide different abrasive properties (e.g., to cut through harder materials) or can include degradation accelerators (e.g., to induce degradation of spent abrasive grit).

The erosion fluid in the erosion fluid supply 302 and secondary erosion fluid supply 314 can be pre-mixed or mixed on-demand as described with reference to FIG. 2. When pre-mixed, the erosion fluid may be easily transportable and storable for extended periods of time without fear of premature degradation of the abrasive grit because the abrasive grit includes metal components. Additionally, carrier fluids with specific pH, carrier fluid with low salinity, or carrier fluids that are oils can aid in the long-term storage and transportation of pre-mixed erosion fluids. Additional carrier fluids or other components can be added to pre-mixed erosion fluids on site before an erosive jetting operation or during an erosive jetting operation.

FIGS. 4-7 show various types of abrasive grit, such as described herein with reference to FIG. 2, including metal components and additional components combined in various ways. In some cases, abrasive grit includes components combined in one or more of the ways described with reference to FIGS. 4-7. (e.g., a combination of mechanically mixed components and encapsulated components). While described herein as combinations of a metal component and an additional component, the disclosure related to FIGS. 4-7 is equally applicable to combinations of multiple additional components of abrasive grit (e.g., no metal component) that are later combined with a metal component. Additionally, any number of additional components (e.g., types of additional components) can be used. The components depicted in FIGS. 4-7 are shown schematically as being generally round, however the actual components can be of any shape and roughness.

Figure 4:
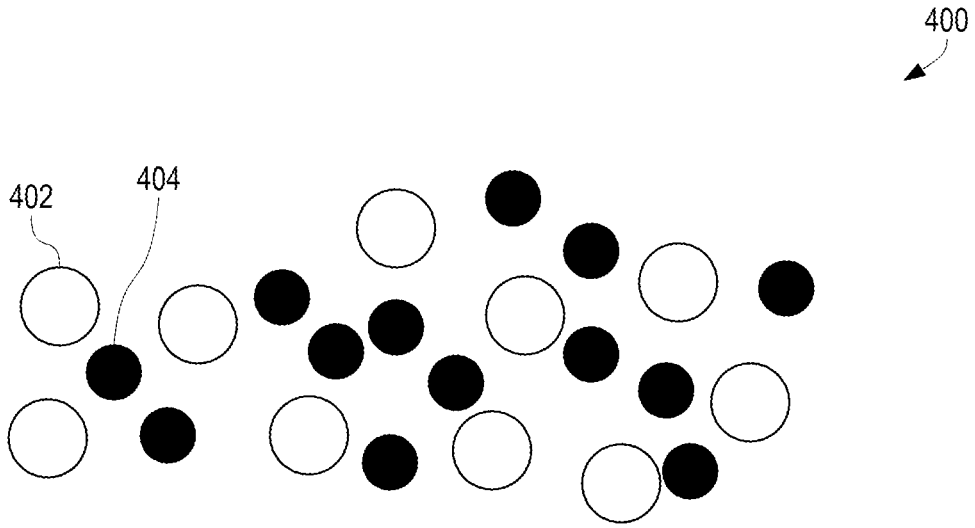
FIG. 4 is a schematic diagram depicting mechanically mixed components of an abrasive grit according to certain aspects of the present disclosure.

FIG. 4 is a schematic diagram depicting mechanically mixed components of an abrasive grit 400 according to certain aspects of the present disclosure. The abrasive grit 400 can include a metal component 404 and an additional component 402 (e.g., to adjust the degradation rate of the abrasive grit). When mechanically mixed, the metal component 404 and additional component 402 can be located near one another in any suitable quantity, which can be readily controlled on-demand.

Figure 5:
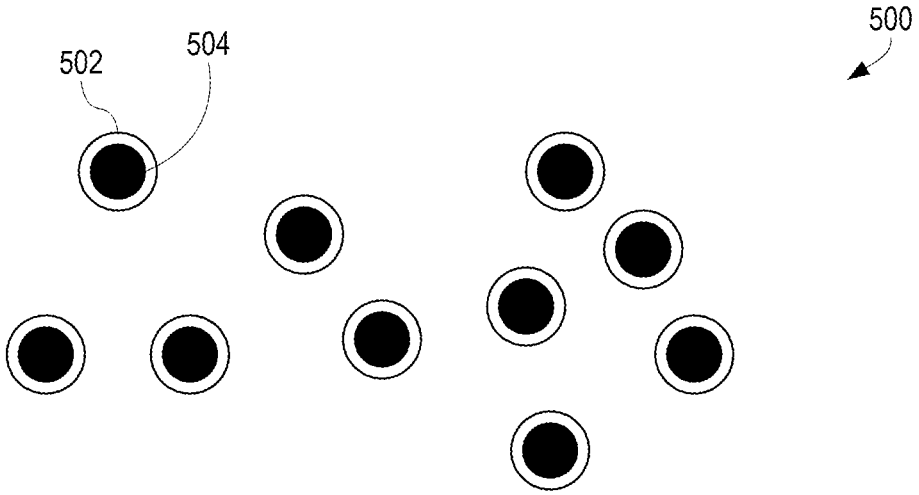
FIG. 5 is a schematic diagram depicting encapsulated components of an abrasive grit according to certain aspects of the present disclosure.

FIG. 5 is a schematic diagram depicting encapsulated components of an abrasive grit 500 according to certain aspects of the present disclosure. The abrasive grit 500 can include a metal component 504 encapsulated within an additional component 502 (e.g., to adjust properties of the abrasive grit). For example, the metal component 504 can be a magnesium-based alloy bead that is encapsulated by an additional component 502 that is a layer of titanium. The metal component 504 (e.g., magnesium-based alloy) can provide the density and toughness necessary to achieve desired erosion, while being degradable in the wellbore fluid. The additional component 502 (e.g., layer of titanium) can provide additional properties, such as an increased rate of degradation or increased density. In some cases, the additional properties of the additional component 502 are enhanced after the pressurized erosion fluid impinges the target material because the mechanical force breaks the additional component 502. The ratio of metal component 504 to additional component 502 may be controlled during an encapsulation process. The encapsulation can be performed with a vapor deposition process, a chemical deposition, or any other layering process.

Figure 6:
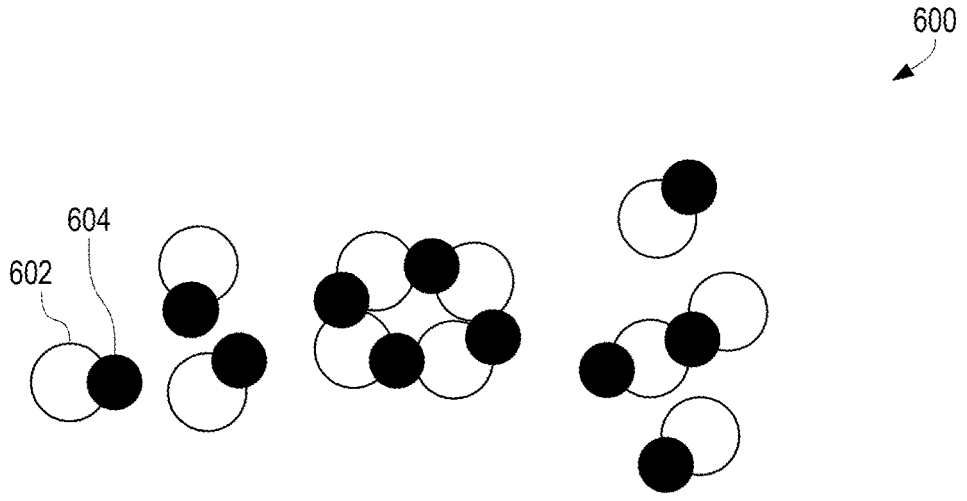
FIG. 6 is a schematic diagram depicting sintered or fused components of an abrasive grit according to certain aspects of the present disclosure.

FIG. 6 is a schematic diagram depicting sintered or fused components of an abrasive grit 600 according to certain aspects of the present disclosure. The abrasive grit 600 can include a metal component 604 and an additional component 602 (e.g., to adjust properties of the abrasive grit). The metal component 604 and additional component 602 can be joined together through sintering, fusing, or the like. The ratios of metal components 604 to additional components 602 can be controlled during a joining process (e.g., sintering or fusing). In some cases, matrixes or structures can be formed, such as a nanostructured matrix. The additional component 602 can be a part to accelerate the degradation of the metal component 604, such as carbon to accelerate an aluminum reaction. In some cases, the additional component 602 can be a non-degradable material that is harder than the degradable metal component 604, which can accelerate erosion, such as a silicon carbide, which can enhance the erosion of a dissolvable aluminum-indium alloy. In some cases, the additional properties of the additional component 602 are enhanced after the pressurized erosion fluid impinges the target material because the mechanical force can breaks apart the additional component 602 from the metal component 504.

Figure 7:
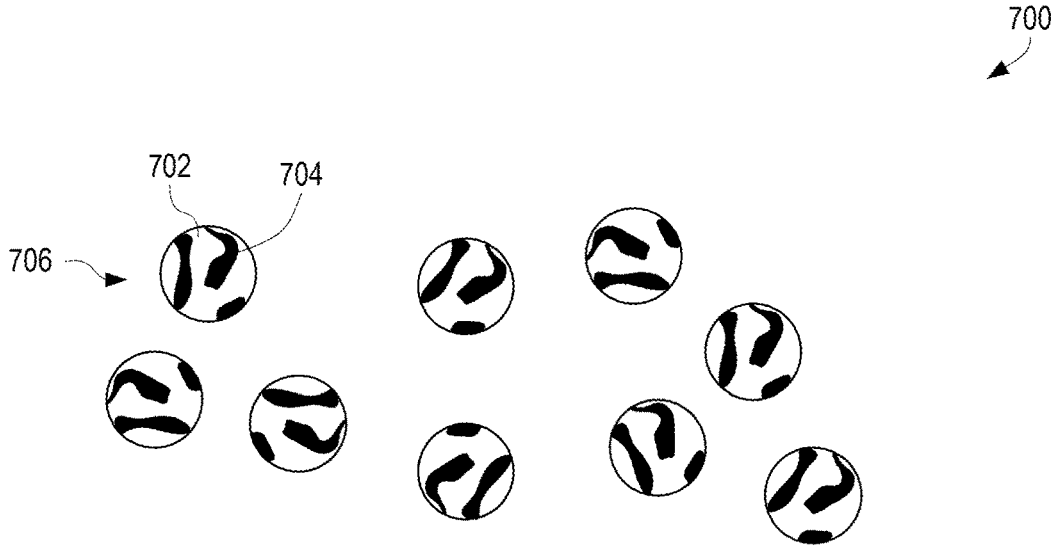
FIG. 7 is a schematic diagram depicting a solid solution of components of an abrasive grit according to certain aspects of the present disclosure.

FIG. 7 is a schematic diagram depicting a solid-solution of components of an abrasive grit 700 according to certain aspects of the present disclosure. The abrasive grit 700 can include a metal component 704 and an additional component 702 (e.g., to adjust properties of the abrasive grit). The metal component 704 can be inclusions (e.g., intergranular inclusions) in a continuous solid phase of the additional component 702, however in some cases, the additional component 702 can be inclusion in a continuous solid phase of the metal component 704. The metal component 704 and additional component 702 can form a single particle 706 (e.g., grain or granule) of abrasive grit. In some cases when the pressurized erosion fluid impinges the target material, the particle 706 can separate due to the mechanical forces on the particle 706. In some cases, the inclusions caused by one of the components can increase the particle's 706 susceptibility to being broken apart (e.g., a form of degradation) due to mechanical impact upon impinging the target material. Additionally, in some cases, the additional properties of the additional component 702 can be enhanced when the particle 706 is broken apart.

Figure 8:
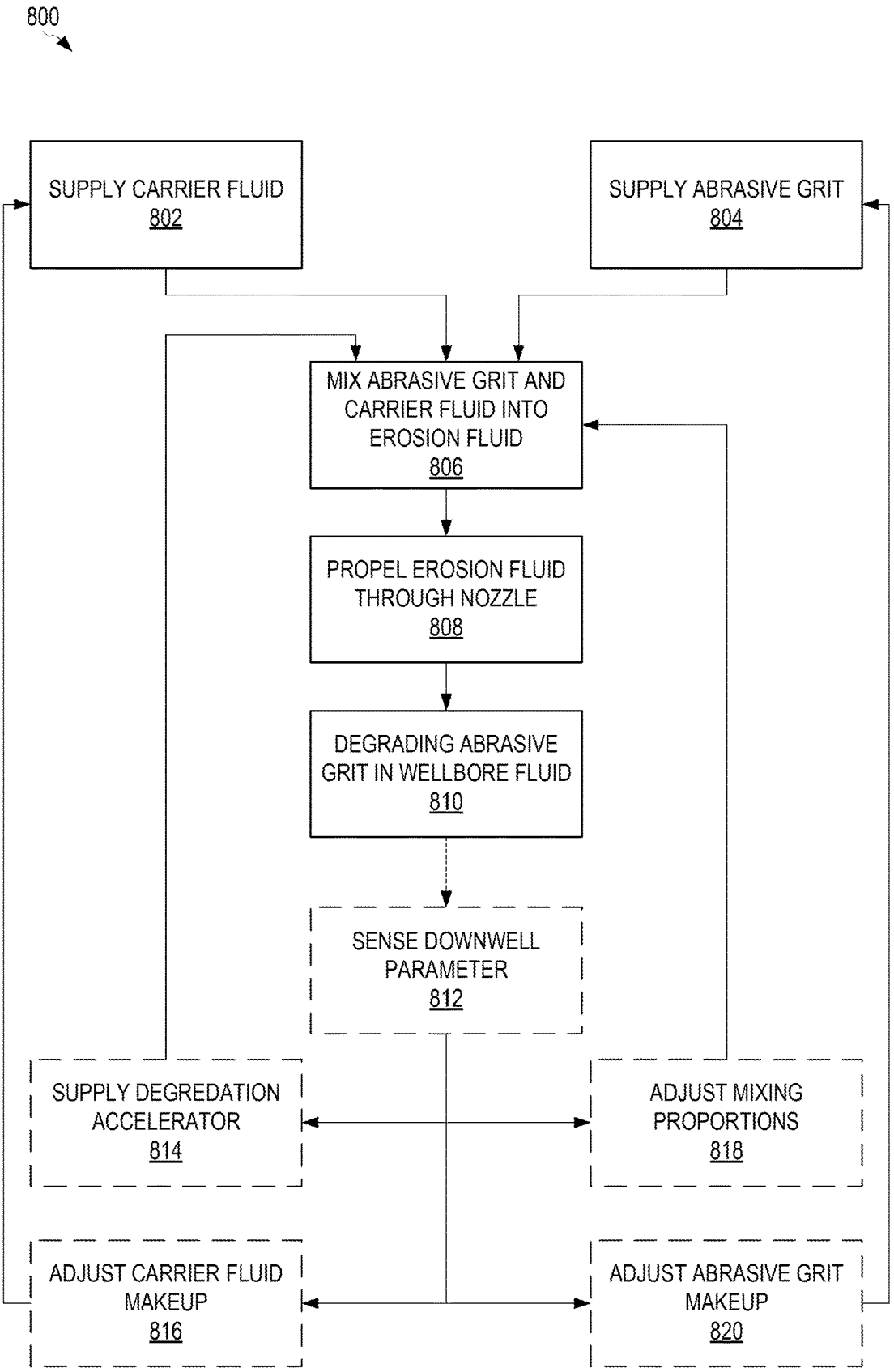
FIG. 8 is a flowchart depicting a process for performing an erosive jetting operation according to certain aspects of the present disclosure.

FIG. 8 is a flowchart depicting a process 800 for performing an erosive jetting operation according to certain aspects of the present disclosure. At block 802, a carrier fluid is supplied. The carrier fluid can include a combination of one or more carrier fluid components (e.g., first and second fluids). At block 804, abrasive grit is supplied. The abrasive grit can include a combination of one or more abrasive grit components (e.g., a metal component and an additional component).

At block 806, the abrasive grit and carrier fluid are mixed together to form the erosion fluid. For example, carrier fluid can be pumped through a mixing chamber and can draw abrasive grit therethrough and entrain the abrasive grit in the carrier fluid. In some cases, blocks 802, 804, and 806 can occur offsite or in advance of an erosive jetting operation. In some cases, blocks 802, 804, and 806 can be performed onsite during an erosive jetting operation.

At block 808, erosion fluid is propelled through a nozzle. The erosion fluid can be pressurized using one or more pumps and can be conveyed to the nozzle through any number of conveyances (e.g., tubulars). Propelling the erosion fluid through the nozzle can include the nozzle receiving pressurized erosion fluid and outputting a jet or stream of erosion fluid. The jet or stream can be aimed to impinge a target material, such as to cut or otherwise erode the target material. The erosion fluid, including any carrier fluid and abrasive grit can be expelled into the area surrounding the target materials, such as within a tubular, within a wellbore, or within a formation. The erosion fluid can mix with other fluids in the wellbore (e.g., wellbore fluids).

At block 810, the abrasive grit can degrade in the wellbore. The abrasive grit can degrade in the presence of the wellbore fluids, including any carrier fluids, degradation accelerators, or other fluids located in the wellbore (e.g., fluids from the formation). As described herein, carrier fluids or degradations accelerators can be designed to induce degradation or enhanced degradation of the abrasive grit in the downhole environment, such as due to the increased temperatures or presence of wellbore fluids in the downhole environment (e.g., as compared to the surface).

In some cases, degrading the abrasive grit in the wellbore fluid at block 810 can specifically include introducing a degradation accelerator into the wellbore or wellbore fluids. Introduction of the degradation accelerator can occur before, during or after propelling erosion fluid through the nozzle. Such degradation accelerator can be introduced through the nozzle or another conveyance.

In some cases, degrading the abrasive grit in the wellbore fluid at block 810 can specifically include introducing an activating agent into the wellbore or wellbore fluids. Introduction of the activating agent can occur before, during or after propelling erosion fluid through the nozzle. Such an activating agent can be introduced through the nozzle or another conveyance. Upon contacting a degradation accelerator, the activating agent can cause the degradation accelerator to induce degradation of the abrasive grit.

At optional block 812, a downhole parameter can be sensed. The downhole parameter can be any parameter as disclosed herein, such as temperature, weight, pressure, or others. A controller can determine an appropriate action to take based on the downhole parameter. Block 812 can occur before or after abrasive grit mixed into the erosion fluid at block 806, the erosion fluid is propelled through the nozzle at block 808, or the abrasive grit is degraded in the wellbore at block 810. In some cases, block 812 can occur continuously or be repeated regularly. In some cases, block 812 can occur in response to degrading the abrasive grit at block 810 (e.g., to determine if additional grit or additional degradation accelerator may be necessary). In some cases, block 812 can occur without respect to degrading the abrasive grit at block 810.

In some cases, the controller can adjust equipment to supply degradation accelerator at block 814 into the mixing at block 806 such that the erosion fluid mixed at block 806 includes additional degradation accelerator. Such an action can be appropriate at various times, such as when the downhole parameter sensed at block 812 is related to completion or nearing completion of the erosive jetting operation (e.g., at which point abrasive grit is desired to be degraded faster).

In some cases, the controller can adjust mixing proportions at block 818, which can affect the proportions of carrier fluid and abrasive grit mixed together at block 806 to form the erosion fluid. Such an action can be appropriate at various times, such as when the downhole parameter sensed at block 812 is related to indications that insufficient pressure is being maintained for an erosive jetting operation (e.g., cutting). Providing more carrier fluid and less abrasive grit may help maintain sufficient pressure of the erosion fluid.

In some cases, the controller can adjust the makeup of the carrier fluid at block 816. This adjustment can change properties of the carrier fluid, such as its pH, specific gravity, density, temperature, or other properties. This adjustment can include controlling how much of various components are mixed together to form the carrier fluid (e.g., a mixture of water and a degradation accelerator). Such an action can be appropriate at various times, such as when the downhole parameter sensed at block 812 is related to completion or nearing completion of the erosive jetting operation (e.g., at which point abrasive grit is desired to be degraded faster).

In some cases, the controller can adjust the makeup of the abrasive grit at block 820. This adjustment can change the ratios of different components of the abrasive grit, which can change the properties of the abrasive grit (e.g., specific gravity, density, degradation rate, hardness, or erosion coefficient). Such an action can be appropriate at various times, such as when the downhole parameter sensed at block 812 is related to indications that a tubular has been cut through and now the system needs to operate to remove paraffin buildup from the inner diameter of a casing and not damage the casing. In this example, the abrasive grit makeup may have originally included components having high densities or high hardness or erosion coefficients to cut the tubular, but after the tubular has been cut, the abrasive grit makeup can be adjusted to include lower density components or components with a lower hardness or erosion coefficient to remove the paraffin buildup without damaging the casing.

Figure 9:
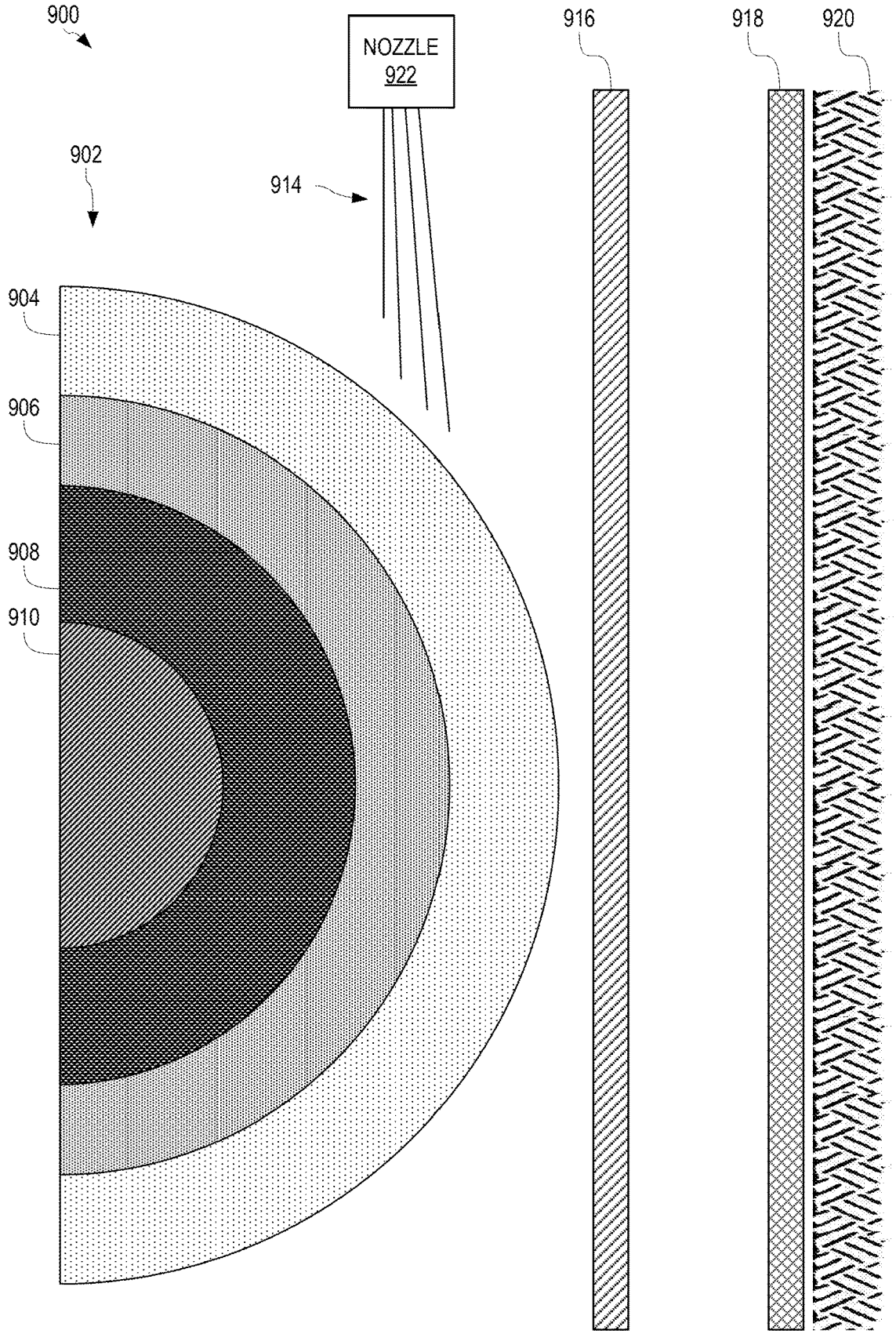
FIG. 9 is a partial cut-away diagram depicting a grinding tool of an erosion device according to certain aspects of the present disclosure.

FIG. 9 is a partial cut-away diagram depicting a grinding tool 902 of an erosion device 900 according to certain aspects of the present disclosure. The erosion device 900 can include a grinding tool 902 and a nozzle 922. The nozzle 922 can supply a working fluid 914 to the grinding tool 902, such as to lubricate the grinding tool 902. The working fluid 914 can be similar to carrier fluids disclosed above with reference to FIGS. 1, 2, and 8.

The grinding tool 902 can include one or more layers of abrasive grit. As seen in FIG. 9, the grinding tool 902 includes a shaft 910 and three layers of abrasive grit. More or fewer layers of abrasive grit can be used, including a single layer. Other styles of grinding tools 902 can be used other than a rotating shaft 910.

The grinding tool 902 can include an outer layer 904, a middle layer 906, and an inner layer 908. The outer layer 904 can include first abrasive grit, the middle layer 906 can include second abrasive grit, and the inner layer 908 can include third abrasive grit. The first abrasive grit, second abrasive grit, and third abrasive grit can all have different properties and can include different combinations of abrasive grit components, as disclosed herein with reference to FIGS. 1-8. For example, the first abrasive grit can have a hardness that is higher than a hardness of a tubular 916, and thus be able to cut through the tubular 916. The second abrasive grit can have a hardness that is higher than a hardness of casing 918, and thus be able to cut through the casing 918. The third abrasive grit can have a hardness that his higher than a hardness of the formation 920, and thus be able to cut through the formation 920. Parameters other than hardness can be used, such as density, roughness, or the like.

During an erosion operation, the grinding tool 902 will rotate and drag the abrasive grit of each layer 904, 906, 908 across the target material (e.g., tubular 916, casing, 918, and formation 920, respectively). The nozzle 922 may initially dispense a working fluid 914 containing mostly water or other grinding lubricant. However, once cutting of the tubular 916 is complete or around that time, the nozzle 922 may dispense a working fluid 914 containing a degradation accelerator capable of degrading the first abrasive grit of the outer layer 904. As the outer layer 904 degrades, the middle layer 906 will be revealed. The nozzle 922 may revert to dispensing a working fluid 914 containing mostly water or other grinding lubricant while the middle layer 906 grinds the casing 918. Once cutting of the casing 918 is complete or around that time, the nozzle 922 may dispense a working fluid 914 containing a degradation accelerator that degrades the middle layer 906, revealing the inner layer 908. The nozzle 922 may revert to dispensing a working fluid 914 containing mostly water or other grinding lubricant while the inner layer 908 grinds the formation 920. At a desired time after grinding the formation 920, the nozzle 922 can again dispense a working fluid 914 containing a degradation accelerator to degrade any remaining abrasive grit in the wellbore. In some cases, degradation accelerators can degrade binding materials used to bind the abrasive grit to a layer.

In some cases, no degradation accelerator is needed, and the layers 904, 906, 908 can be designed with suitable thicknesses to naturally degrade sufficiently (e.g., to reveal the subsequent layer) during appropriate grinding operations (e.g., cutting of a tubular). In some cases, the working fluid 914 can include degradation accelerators targeted specifically for a particular layer 904, 906, 908 (e.g., targeted to the specific abrasive grit used on that layer or to the specific binders used on that layer). Therefore, application of a degradation accelerator targeted for the outer layer 904 may induce no or very little degradation of the middle layer 906. Binders can be made of dissolvable or degradable plastics, such as those described above (e.g., PLA, PGA, PVA, and others).

As described elsewhere herein with reference to erosive jetting operations, such as with reference to FIGS. 1 and 8, one or more sensors and controllers can be used to make adjustments in the grinding operation. For example, upon detection that a tubular has been cut through, a controller can adjust the makeup of the working fluid 914 exiting nozzle 922 to include degradation accelerators.

Specific details are given in the foregoing description to provide a thorough understanding of various aspects of the present disclosure. However, various aspects of the present disclosure may be practiced without these specific details. For example, processes and other components may be shown as components in block diagram form in order not to obscure the disclosure in unnecessary detail. In other instances, well-known circuits, processes, algorithms, structures, and techniques may be shown without unnecessary detail in order to avoid obscuring the disclosure.

Also, it is noted that individual aspects of the present disclosure may be described as a process, which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional operations not included in a figure.

The foregoing description of the embodiments, including illustrated examples, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a method, comprising supplying an erosion fluid to a downhole tool having a nozzle, the erosion fluid having an abrasive grit carried in a carrier fluid, the abrasive grit having a metal component and being degradable within wellbore fluid; outputting the erosion fluid through the nozzle at a pressure suitable for eroding a target material;

and exposing the erosion fluid to the wellbore fluid to allow the erosion fluid to degrade within the wellbore fluid.

Example 2 is the method of example 1, further comprising adjusting a composition of the erosion fluid, wherein adjusting the composition of the erosion fluid includes mixing an additional carrier fluid component into the erosion fluid, wherein the additional carrier fluid component is selected to alter a susceptibility of the abrasive grit to degrade within the wellbore fluid.

Example 3 is the method of examples 1 or 2, further comprising adjusting a composition of the erosion fluid by mixing an additional grit component into the erosion fluid, wherein the additional grit component is selected to alter a susceptibility of the abrasive grit to degrade within the wellbore fluid.

Example 4 is the method of examples 1-3, further comprising determining a downhole parameter; and adjusting a susceptibility of the abrasive grit to degrade within the wellbore fluid based on the downhole parameter, wherein adjusting the susceptibility of the abrasive grit to degrade includes adjusting a composition of the erosion fluid, adjusting a composition of the abrasive grit, or supplying a degradation accelerator.

Example 5 is the method of examples 1-4, wherein the erosion fluid includes a temperature-activated or pH-activated component for altering a susceptibility of the abrasive grit to degrade in the wellbore fluid upon activation of the temperature-activated or pH-activated component in a downhole environment.

Example 6 is the method of example 5, wherein the temperature-activated or pH-activated component is a temperature-activated component, and wherein the method further comprises contacting the temperature-activated component with the wellbore fluid in the downhole environment to activate the pH-activated component.

Example 7 is the method of examples 1-6, wherein the metal component is an alloy selected from the group consisting of a magnesium alloy, an aluminum alloy, a zinc alloy, an iron alloy, and a tin alloy.

Example 8 is the method of example 7, further comprising increasing a specific gravity of the abrasive grit by introducing an additional component to the abrasive grit, wherein a specific gravity of the additional component is higher than a specific gravity of the metal component.

Example 9 is the method of examples 7 or 8, further comprising increasing an erosive coefficient of the abrasive grit by introducing an additional component to the abrasive grit, wherein a hardness of the additional component is higher than a hardness of the metal component.

Example 10 is an erosion fluid for use in a downhole erosive jet device, the erosion fluid comprising an abrasive grit comprising a metal component and being degradable within wellbore fluid; and a carrier fluid for conveying the abrasive grit, wherein the carrier fluid is selected to resist degradation of the abrasive grit.

Example 11 is the erosion fluid of example 10, further comprising a degradation accelerator mixable with the abrasive grit to induce degradation of the abrasive grit in the downhole environment.

Example 12 is the erosion fluid of example 11, wherein the degradation accelerator includes a temperature-activated or pH-activated component that is activatable by the downhole environment to induce degradation of the abrasive grit.

Example 13 is the erosion fluid of examples 10-12, wherein the metal component is an alloy selected from the group consisting of a magnesium alloy, an aluminum alloy, a zinc alloy, an iron alloy, and a tin alloy.

Example 14 is the erosion fluid of example 13, wherein the abrasive grit further includes an additional component having a specific gravity that is higher than a specific gravity of the metal component.

Example 15 is the erosion fluid of examples 13 or 14, wherein the abrasive grit further includes an additional component having a hardness that is higher than a hardness of the metal component.

Example 16 is a downhole erosion jet system comprising an erosion fluid source for supplying an erosion fluid having an abrasive grit carried in a carrier fluid, the abrasive grit having a metal component and being degradable within wellbore fluid; a pump coupled to the erosion fluid source for pressurizing the erosion fluid; and a nozzle coupled to the pump to receive the pressurized erosion fluid and output the pressurized erosion fluid as an erosion jet suitable for exposing the erosion fluid to the wellbore fluid and allowing the abrasive grit to degrade within the wellbore fluid.

Example 17 is the system of example 16, further comprising a degradation accelerator source for supplying a degradation accelerator adjacent the nozzle, wherein the degradation accelerator induces degradation of the abrasive grit in a downhole environment.

Example 18 is the system of examples 16 or 17, wherein the erosion fluid source includes one or more carrier fluid pumps for pressurizing one or more carrier fluid components and a mixing chamber for combining the one or more carrier fluid components with one or more abrasive grit components.

Example 19 is the system of examples 16-18, wherein the metal component is an alloy selected from the group consisting of a magnesium alloy, an aluminum alloy, a zinc alloy, an iron alloy, and a tin alloy.

Example 20 is the system of examples 16-19, further comprising a sensor for measuring a downhole parameter and a controller coupled to the sensor and the erosion fluid source for adjusting a composition of the erosion fluid in response to the downhole parameter.

What is claimed is:

1. A method, comprising:

receiving, by a controller, sensor data from a sensor, the sensor data indicating a value of a downhole parameter;

automatically adjusting, by the controller, a composition of an erosion fluid based on the value of the downhole parameter measured by the sensor;

supplying the erosion fluid to a downhole tool having a nozzle, the erosion fluid having an abrasive grit carried in a carrier fluid, the abrasive grit having a metal component and being degradable within wellbore fluid;

outputting the erosion fluid through the nozzle at a pressure suitable for eroding a target material; and exposing the erosion fluid to the wellbore fluid to allow the erosion fluid to degrade within the wellbore fluid.

2. The method of claim 1, wherein automatically adjusting the composition of the erosion fluid includes mixing an additional carrier fluid component into the erosion fluid, wherein the additional carrier fluid component is selected to alter a susceptibility of the abrasive grit to degrade within the wellbore fluid.

3. The method of claim 1, wherein automatically adjusting the composition of the erosion fluid involves mixing an additional grit component into the erosion fluid, wherein the additional grit component is selected to alter a susceptibility of the abrasive grit to degrade within the wellbore fluid.

4. The method of claim 1, wherein automatically adjusting the composition of the erosion fluid involves adjusting a susceptibility of the abrasive grit to degrade within the wellbore fluid based on the value of the downhole parameter.

5. The method of claim 1, wherein the erosion fluid includes a temperature-activated component for altering a susceptibility of the abrasive grit to degrade in the wellbore fluid upon activation of the temperature-activated component in a downhole environment.

6. The method of claim 5, further comprising contacting the temperature-activated component with the wellbore fluid in the downhole environment to activate the temperature-activated component.

7. The method of claim 1, further comprising increasing a specific gravity of the abrasive grit by introducing an additional component to the abrasive grit, wherein a specific gravity of the additional component is higher than a specific gravity of the metal component.

8. The method of claim 1, further comprising increasing an erosive coefficient of the abrasive grit by introducing an additional component to the abrasive grit, wherein a hardness of the additional component is higher than a hardness of the metal component.

9. The method of claim 1, wherein the carrier fluid is selected to resist degradation of the abrasive grit.

10. The method of claim 1, further comprising:

outputting the erosion fluid in a wellbore; and subsequent to outputting the erosion fluid in the wellbore, supplying a degradation accelerator into the wellbore, the degradation accelerator being separate from the erosion fluid and being configured to assist in degrading the abrasive grit.

11. The method of claim 1, wherein the wellbore fluid is separate from the erosion fluid, and wherein the wellbore fluid is a production fluid introduced into a wellbore separately from the erosion fluid being introduced into the wellbore.

12. A system for generating an erosion fluid that includes an abrasive grit carried in a carrier fluid, the system comprising:

an abrasive grit supply including the abrasive grit that is degradable in a well fluid;

a carrier fluid supply including the carrier fluid for conveying the abrasive grit; and a controller coupled to the abrasive grit supply and the carrier fluid supply, the controller being configured to automatically adjust a composition of the erosion fluid based on a measured value of a downhole parameter received from a sensor, wherein the controller is configured to automatically adjust the composition of the erosion fluid by modifying an amount of the abrasive grit or the carrier fluid included in the erosion fluid.

13. The system of claim 12, further comprising a degradation accelerator source coupled to the controller, the degradation accelerator source including a degradation accelerator that is mixable with the abrasive grit to induce degradation of the abrasive grit in a downhole environment.

14. The erosion fluid system of claim 13, wherein the degradation accelerator includes a temperature-activated component that is activatable by the downhole environment to induce degradation of the abrasive grit.

15. The system of claim 12, wherein the abrasive grit further includes an additional component having a specific gravity that is higher than a specific gravity of a metal component in the abrasive grit.

16. The system of claim 12, wherein the abrasive grit further includes an additional component having a hardness that is higher than a hardness of a metal component in the abrasive grit.

17. A downhole erosion jet system comprising:

an erosion fluid source for supplying an erosion fluid having an abrasive grit carried in a carrier fluid, the abrasive grit having a metal component and being degradable within a wellbore fluid;

a pump coupled to the erosion fluid source for pressurizing the erosion fluid;

a nozzle coupled to the pump to receive the pressurized erosion fluid and output the pressurized erosion fluid as an erosion jet suitable for exposing the erosion fluid to the wellbore fluid and allowing the abrasive grit to degrade within the wellbore fluid;

a sensor configured to measure a downhole parameter and transmit sensor data indicating a value of the downhole parameter; and a controller coupled to the sensor and the erosion fluid source, the controller being configured to receive the sensor data and automatically adjust a composition of the erosion fluid based on the measured value of the downhole parameter.

18. The system of claim 17, further comprising a degradation accelerator source for supplying a degradation accelerator, wherein the degradation accelerator induces degradation of the abrasive grit in a downhole environment.

19. The system of claim 17, wherein the erosion fluid source includes one or more carrier fluid pumps for pressurizing one or more carrier fluid components and a mixing chamber for combining the one or more carrier fluid components with one or more abrasive grit components.

20. The system of claim 17, wherein the carrier fluid is selected to resist degradation of the abrasive grit.

* * * * *